US012398921B2

(12) United States Patent
Haydock et al.

(10) Patent No.: US 12,398,921 B2
(45) Date of Patent: Aug. 26, 2025

(54) HEAT EXCHANGER BAFFLE ASSEMBLY WITH HORIZONTAL GAP

(71) Applicant: Carrier Corporation, Palm Beach Gardens, FL (US)

(72) Inventors: Paul M. Haydock, Zionsville, IN (US); Pratap Kumar DVS, Hyderabad (IN); Asad M. Sardar, Avon, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 120 days.

(21) Appl. No.: 17/445,274

(22) Filed: Aug. 17, 2021

(65) Prior Publication Data

US 2022/0065495 A1 Mar. 3, 2022

Related U.S. Application Data

(60) Provisional application No. 62/706,575, filed on Aug. 26, 2020.

(51) Int. Cl.

| | |
|---|---|
| ***F24H 3/10*** | (2022.01) |
| ***F24H 9/00*** | (2022.01) |
| *F24F 5/00* | (2006.01) |
| *F24H 3/06* | (2022.01) |

(52) U.S. Cl.
CPC ..... *F24H 3/10* (2013.01); *F24H 9/0063* (2013.01)

(58) Field of Classification Search
CPC ..... F24F 5/0096; F24H 3/065; F24H 3/10; F24H 9/0063
See application file for complete search history.

(56) References Cited

U.S. PATENT DOCUMENTS

| | | | | | |
|---|---|---|---|---|---|
| 1,830,412 | A | * | 11/1931 | Stark | F24H 3/065 165/145 |
| 2,263,732 | A | * | 11/1941 | Johnston | F24H 3/065 126/110 R |
| 2,290,978 | A | * | 7/1942 | Livar | F24H 3/065 165/122 |
| 2,884,048 | A | * | 4/1959 | Marble | F24H 3/105 126/110 R |
| 3,130,752 | A | * | 4/1964 | Gerken | F24F 13/02 138/89 |

(Continued)

FOREIGN PATENT DOCUMENTS

| | | | |
|---|---|---|---|
| KR | 20020004474 A | * | 1/2002 |
| WO | WO-2021112570 A1 | * | 6/2021 |

*Primary Examiner* — Michael G Hoang
*Assistant Examiner* — Logan P Jones
(74) *Attorney, Agent, or Firm* — Souad Hakim

(57) ABSTRACT

A furnace with a baffle assembly including at least one horizontal gap, and a heating, ventilation, and/or air conditioning (HVAC) system incorporating the same are provided. The furnace includes a furnace heat exchanger, a baffle assembly, and a fan. The baffle assembly is disposed adjacent to the furnace heat exchanger. The fan is in airflow communication with the furnace heat exchanger. The baffle assembly may include a first side and a second side. Each of the first side and the second side may respectively include a first section and a second section. A horizontal gap may be disposed between the first section and the second section (e.g., on either or both of the first side and the second side). The horizontal gap(s) may increase the efficiency of the furnace and/or the HVAC system.

16 Claims, 5 Drawing Sheets

(56) References Cited

U.S. PATENT DOCUMENTS

| | | | | | |
|---|---|---|---|---|---|
| 3,394,695 | A * | 7/1968 | Boden | F24H 3/105 | 126/110 R |
| 3,638,636 | A * | 2/1972 | Marshall | F24H 9/0052 | 126/110 R |
| 4,143,707 | A * | 3/1979 | Lewis | F24D 19/1087 | 165/242 |
| 4,537,178 | A * | 8/1985 | Hwang | F24H 3/065 | 237/55 |
| 4,561,421 | A * | 12/1985 | Hwang | F24H 3/065 | 126/99 D |
| 9,927,133 | B2 * | 3/2018 | Kojima | F24F 11/62 | |
| 10,533,772 | B2 | 1/2020 | Lemon | | |
| 2003/0127087 | A1 * | 7/2003 | Hill | F24H 3/105 | 126/110 R |
| 2012/0199109 | A1 * | 8/2012 | Thompson | F27D 7/04 | 126/112 |
| 2016/0091221 | A1 * | 3/2016 | Wadia | F24H 9/0057 | 126/114 |
| 2016/0131395 | A1 * | 5/2016 | Wagers | F24H 8/00 | 126/99 D |
| 2016/0131397 | A1 * | 5/2016 | Wagers | F24H 9/0068 | 126/99 D |

* cited by examiner

HEAT EXCHANGER BAFFLE ASSEMBLY WITH HORIZONTAL GAP

CROSS REFERENCE TO A RELATED APPLICATION

The application claims the benefit of U.S. Provisional Application No. 62/706,575 filed Aug. 26, 2020, the contents of which are hereby incorporated in their entirety.

BACKGROUND

Modern heating, ventilation, and/or air conditioning (HVAC) systems may include both an evaporator coil and a furnace. The evaporator coil and the furnace are often configured in a stacked manner. Meaning that airflow through the system may be passed in series, vertically through both the evaporator coil and the furnace.

The evaporator coil may be configured to couple with an outdoor HVAC unit (e.g., a condenser or heat pump circulating refrigerant between the evaporator coil and the outdoor HVAC unit) to provide cooling for the home in warmer months. The furnace may be configured to utilize an energy source (e.g., burning a combustible gas, such as, natural gas or propane, or generating a resistance with electricity) to provide heating for the home in colder months. To direct air through the furnace, the furnace may include a fan (which may be commonly referred to as a blower), which may be configured either between or below the evaporator coil and/or the furnace.

Conventionally, these HVAC systems include one or more baffles in the furnace to direct the airflow through the furnace. When used, these baffles are commonly configured as solid pieces of sheet metal positioned around the exterior perimeter of the furnace heat exchanger. When the furnace is operating, the baffles may help reduce hotspots in the furnace and increase the heating efficiency (e.g., by guiding the flow of the air through the furnace, causing the air to transfer heat from the furnace heat exchanger). However, the typical configuration (as solid pieces of sheet metal) of the baffles may result in non-uniform temperature, velocity, and/or pressure profiles, which may cause the furnace (and therefore the HVAC system) to be less efficient than may otherwise be possible. For example, non-uniform velocity and/or pressure may cause the fan to consume more energy than may be necessary. With ever-increasing standards regarding energy efficiency for HVAC systems, it is vitally important to mitigate and/or prevent any inefficiencies in order to meet such standards.

Accordingly, there remains a need for a furnace and a heating, ventilation, and/or air conditioning (HVAC) system that mitigate inefficiencies caused by the baffles.

BRIEF DESCRIPTION

According to one embodiment, a heating, ventilation, and/or air conditioning (HVAC) is provided. The HVAC system includes an evaporator coil and a furnace in airflow communication with the evaporator coil. The furnace includes a furnace heat exchanger, a baffle assembly, and a fan. The baffle assembly is disposed adjacent to the furnace heat exchanger. The baffle assembly includes at least one horizontal gap. The fan is in airflow communication with the furnace heat exchanger and the evaporator coil.

In accordance with additional or alternative embodiments, the baffle assembly includes a first side and a second side, at least one of the first side and the second side respectively including a first section and a second section, the at least one horizontal gap disposed between the first section and the second section.

In accordance with additional or alternative embodiments, the first section of the first side includes a first leg and a second leg, a first angle defined between the first leg and the second leg.

In accordance with additional or alternative embodiments, the first angle is between 130° and 160°.

In accordance with additional or alternative embodiments, the first leg of the first section of the first side and the second section of the first side are approximately planar.

In accordance with additional or alternative embodiments, the second section of the second side includes a first leg and a second leg, a second angle defined between the first leg and the second leg.

In accordance with additional or alternative embodiments, the second angle is between 130° and 160°.

In accordance with additional or alternative embodiments, the first section of the second side and the first leg of the second section of the second side are approximately parallel.

In accordance with additional or alternative embodiments, the furnace heat exchanger includes a first bend, a second bend, and a third bend, the second bend offset from the first bend and the third bend.

According to another aspect of the disclosure, a furnace is provided. The furnace includes a furnace heat exchanger, a baffle assembly and a fan. The baffle assembly is disposed adjacent to the furnace heat exchanger. The baffle assembly includes at least one horizontal gap. The fan is in airflow communication with the furnace heat exchanger.

In accordance with additional or alternative embodiments, the baffle assembly includes a first side and a second side, each of the first side and the second side respectively including a first section and a second section, the at least one horizontal gap disposed between the first section and the second section.

In accordance with additional or alternative embodiments, the first section of the first side includes a first leg and a second leg, a first angle defined between the first leg and the second leg.

In accordance with additional or alternative embodiments, the first angle is between 130° and 160°.

In accordance with additional or alternative embodiments, the first leg of the first section of the first side and the second section of the first side are approximately planar.

In accordance with additional or alternative embodiments, the second section of the second side includes a first leg and a second leg, a second angle defined between the first leg and the second leg.

In accordance with additional or alternative embodiments, the second angle is between 130° and 160°.

In accordance with additional or alternative embodiments, the first section of the second side and the first leg of the second section of the second side are approximately parallel.

In accordance with additional or alternative embodiments, the furnace heat exchanger includes a first bend, a second bend, and a third bend, the second bend offset from the first bend and the third bend.

BRIEF DESCRIPTION OF THE DRAWINGS

The subject matter, which is regarded as the disclosure, is particularly pointed out and distinctly claimed in the claims at the conclusion of the specification. The following descriptions of the drawings should not be considered limiting in any way. With reference to the accompanying drawings, like elements are numbered alike:

DETAILED DESCRIPTION

A furnace with a baffle assembly and a heating, ventilation, and/or air conditioning (HVAC) system incorporating the furnace are provided. The furnace, through the use of a baffle assembly with at least one horizontal gap, may have increased efficiency when compared to traditional furnaces with baffle assemblies that do not have a horizontal gap (e.g., commonly formed out of one solid piece of sheet metal). This efficiency may be viewed in terms of power savings (e.g., by the fan). For example, by incorporating the baffle assembly described herein, power consumption may be able to be reduced (e.g., by as much as 1.35%), when compared with systems that incorporate baffle assemblies that do not have a horizontal gap. In addition to providing increased efficiency, the baffle assembly may also provide a more uniform transfer of heat. For example, the temperature contour of the air leaving the furnace may be more uniform (e.g., with reduced cross-sectional area of hot and cold sections) when compared to furnaces that incorporate baffle assemblies that do not have a horizontal gap. It should be appreciated that although the baffle assembly may be used within any configuration of an HVAC system or furnace, for purposes of clarity and brevity, the baffle assembly has only been depicted in terms of an HVAC system with a furnace and evaporator in a stacked configuration.

Figure 1:
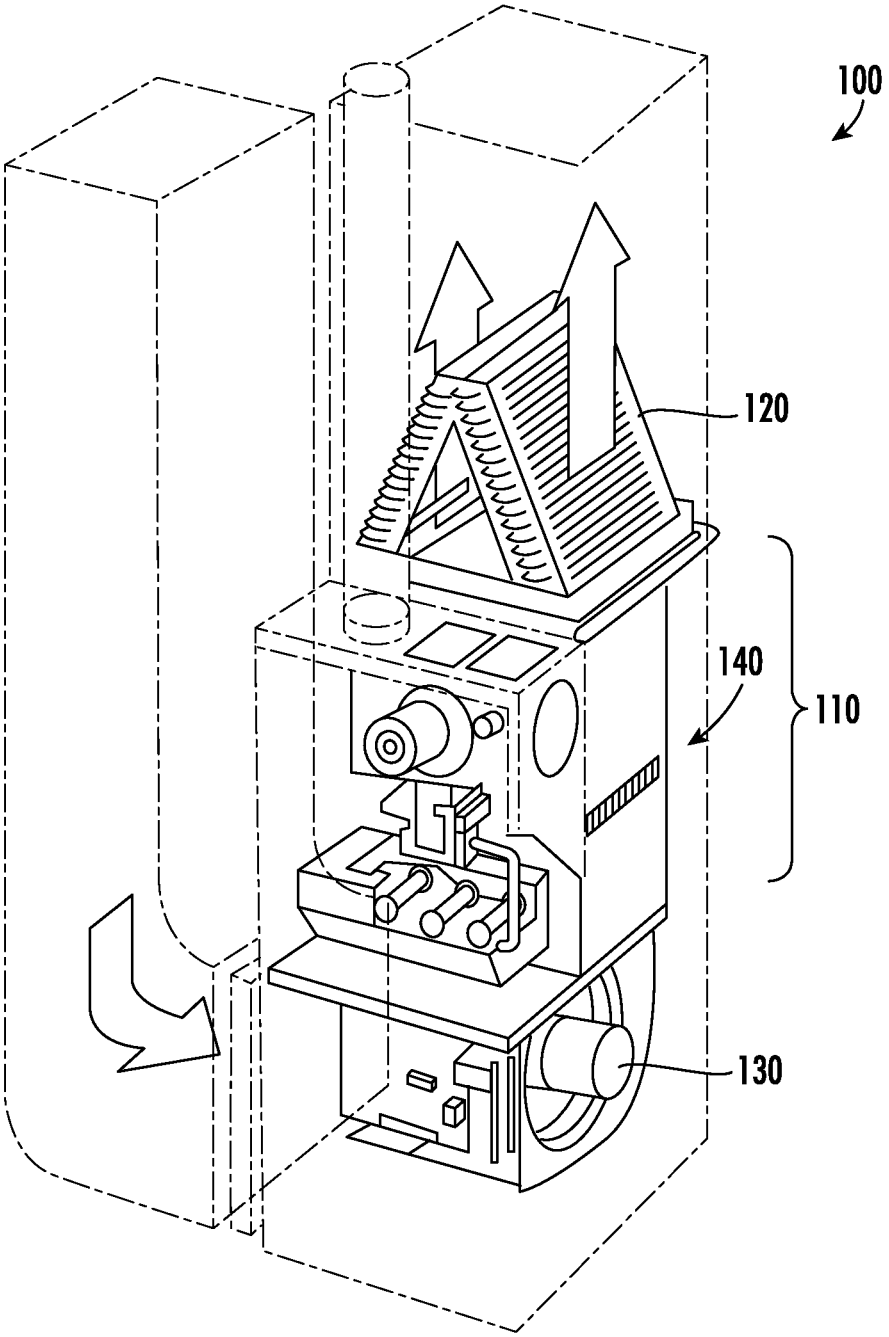
FIG. 1 is a perspective view of a heating, ventilation, and/or air conditioning (HVAC) system with a furnace in accordance with one aspect of the disclosure.
Figure 2:
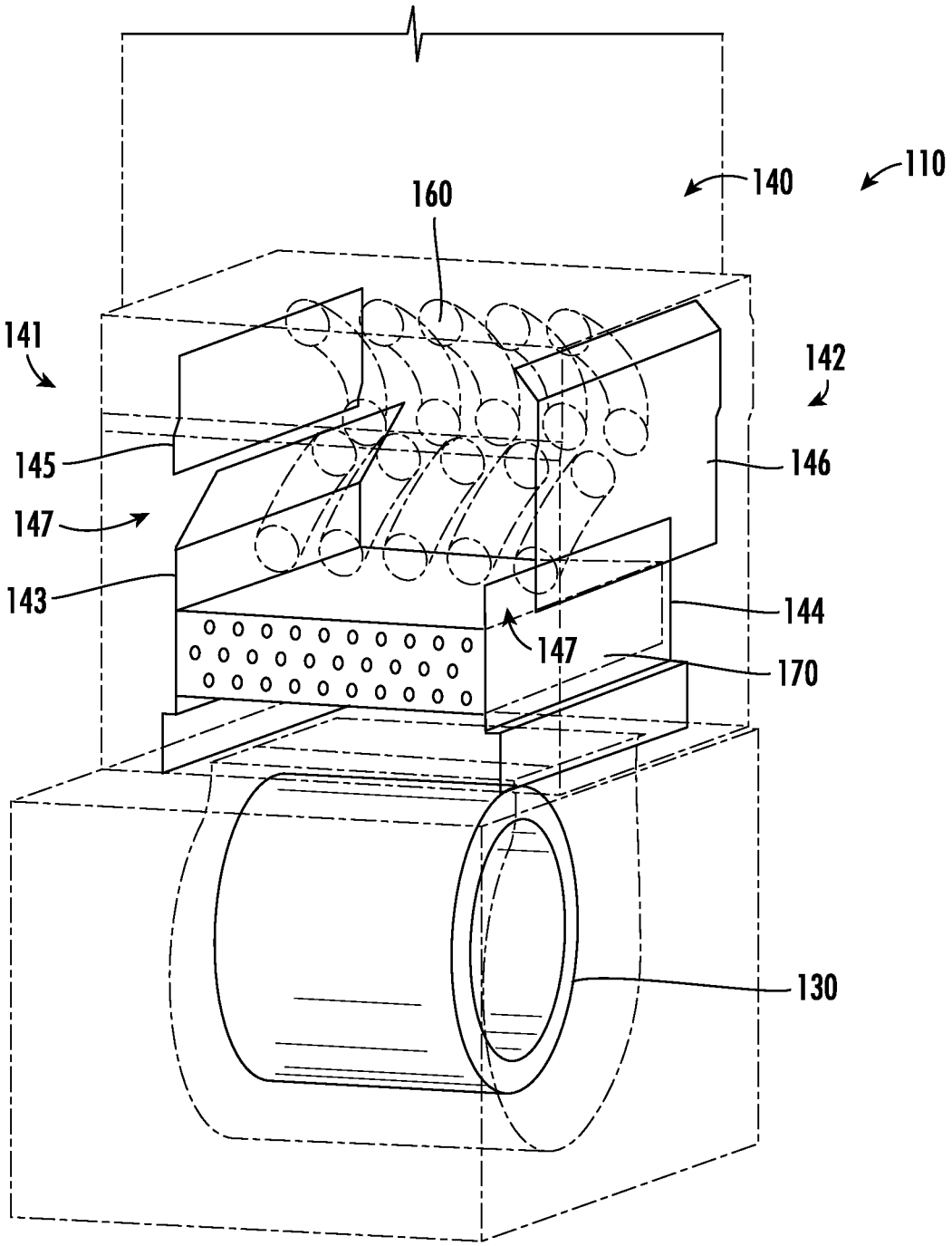
FIG. 2 is a perspective view of the furnace shown in FIG. 1 with a baffle assembly disposed adjacent to a furnace heat exchanger in accordance with one aspect of the disclosure.
Figure 3:
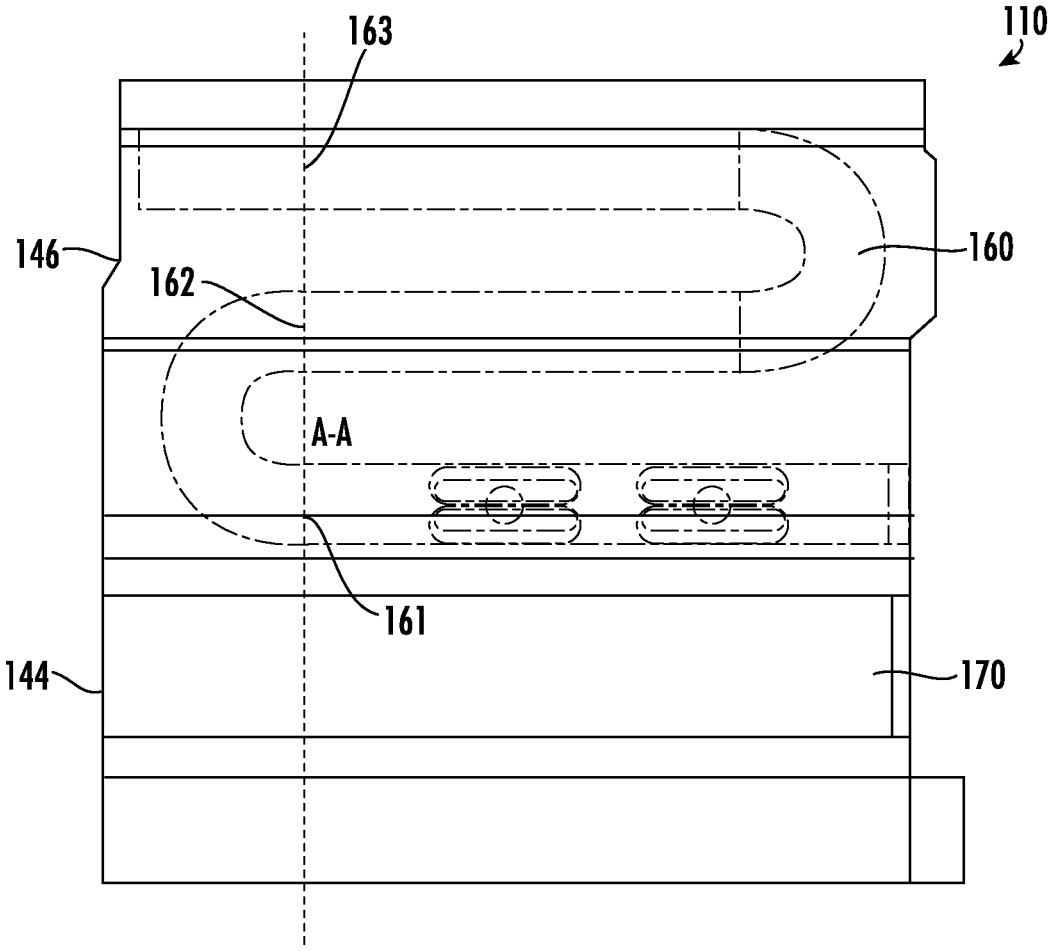
FIG. 3 is a side view of the furnace heat exchanger shown in FIG. 2 in accordance with one aspect of the disclosure.
Figure 4:
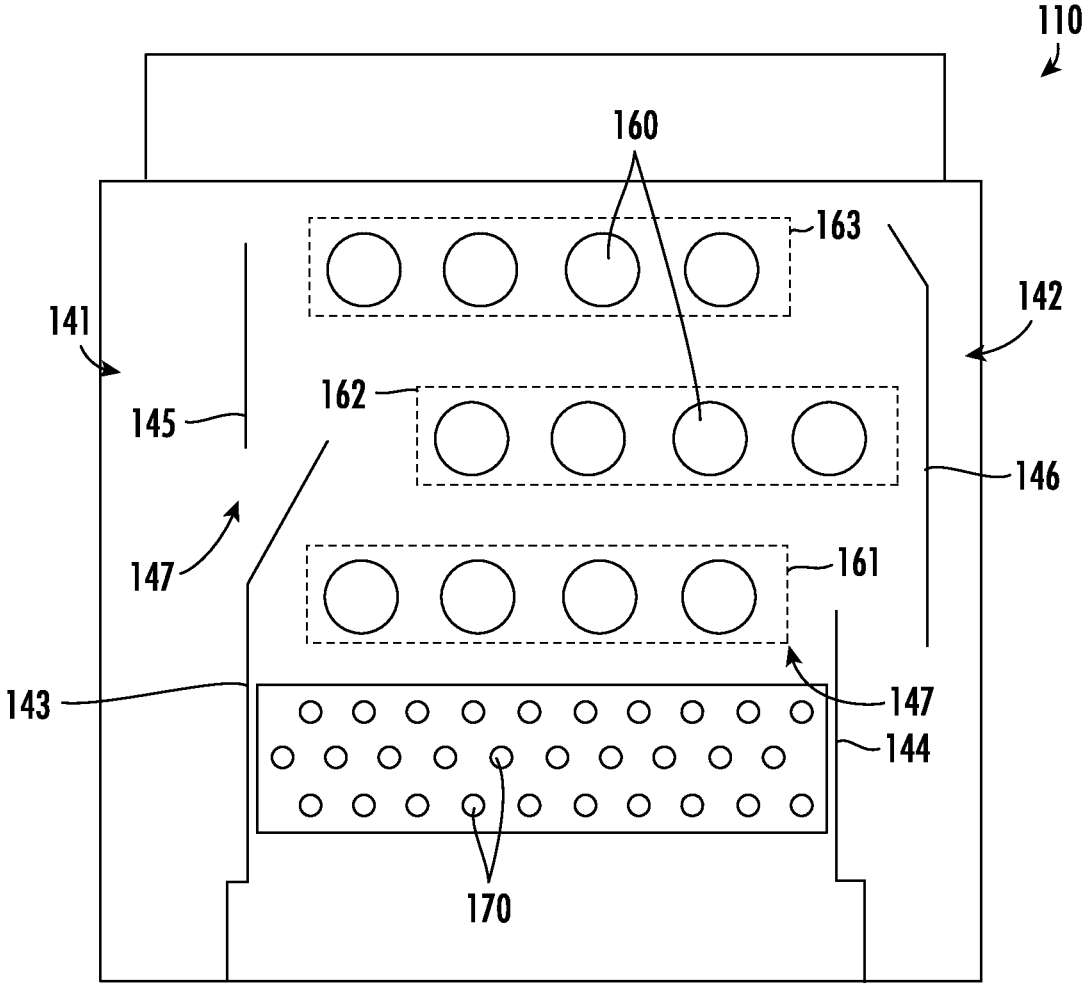
FIG. 4, is a cross-sectional view taken along cross-sectional line A-A from FIG. 3, depicting the baffle assembly adjacent to the furnace heat exchanger, the baffle assembly including a first side and a second side, in accordance with one aspect of the disclosure.

With reference now to the Figures, an exemplary heating, ventilation, and/or air conditioning (HVAC) system 100 is shown in FIG. 1. The HVAC system 100 includes an evaporator coil 120 and a furnace 110 with a fan 130. As shown in FIG. 1, the furnace 110 is disposed upstream of the evaporator coil 120. As shown in FIGS. 2-4, the furnace 110 includes a furnace heat exchanger 160 and a baffle assembly 140 disposed adjacent to the furnace heat exchanger 160. The fan 130 is configured to direct (e.g., in series) an airflow through each of the furnace 110 and the evaporator coil 120. It should be appreciated that regardless of whether the HVAC system 100 is in a heating mode (e.g., where heat is transferred to the air passing through the HVAC system 100) or a cooling mode (e.g., where heat is transferred from the air passing through the HVAC system 100), the baffle assembly 140 may be in a fixed position (e.g., meaning that the baffle assembly 140 may not actuate to alter the cross-sectional area for the airflow to pass through the furnace 110).

The HVAC system 100 may be configured so that substantially all of the airflow is directed through at least a portion of the furnace heat exchanger 160 and through at least a portion of the evaporator coil 120. For example, the baffle assembly 140 may be configured such that approximately none of airflow circumvents (e.g., goes around) the furnace heat exchanger 160. In certain instances, such as when the HVAC system 100 incorporates the evaporator coil 120 downstream of the furnace 110, as shown in FIG. 1, substantially all of the airflow that passes through the furnace heat exchanger 160 also passes through the evaporator coil 120.

Substantially all of the airflow being directed through a heat exchanger (e.g., either through the furnace heat exchanger 160 and/or through the evaporator coil 120) may be interpreted to mean that the entire volume of airflow that enters the HVAC system 100 passes through and/or between the particular heat exchanger 160, 120. For example, the HVAC system 100 may not utilize an alternate flow path (e.g., a bypass duct) around the furnace heat exchanger 160 and/or evaporator coil 120. Instead of allowing the airflow to bypass the furnace heat exchanger 160 and/or the evaporator coil 120, the HVAC system 100 incorporates a fixed (e.g., non-actuating) baffle assembly 140 with at least one horizontal gap 147 (shown in FIGS. 2 and 4). The horizontal gap(s) 147 may serve to both (i) create a pressure relief, and (ii) direct airflow in a more uniform pattern over the furnace heat exchanger 160.

As mentioned above, the baffle assembly 140 described herein may be useful in any furnace 110. For example, the baffle assembly may be useful in either a condensing furnace (e.g., that includes a condensing heat exchanger 170 in addition to the furnace heat exchanger 160, as shown in FIGS. 2-4) or a non-condensing furnace (e.g., that does not have a condensing heat exchanger 170). Although shown to include thirty tubes it should be appreciated that the condensing heat exchanger 170 (when included) may include any number of tubes (e.g., as few as ten tubes or as many as forty-five tubes). Regardless of whether the furnace 110 is a condensing furnace or a non-condensing furnace, the baffle assembly 140 may help to increase the efficiency of the furnace 110 and/or the HVAC system 100 of which may incorporate the furnace 110.

As shown in FIGS. 2 and 4, the baffle assembly 140 may include a first side 141 and a second side 142. At least one of the first side 141 and the second side 142 may be composed of multiple independent sections. For example, at least one of the first side 141 and the second side 142 may include a first section 143, 144 and a second section 145, 147, respectively. In certain instances, the horizontal gap(s) 147 may be disposed between the first section 143, 144 and the second section 145, 146, respectively. As shown in FIGS. 2 and 4, in certain instances both the first side 141 and the second side 142 may include a horizontal gap 147. For example, a horizontal gap 147 may be disposed between the first section 143 and the second section 145 on the first side 141, and a horizontal gap 147 may be disposed between the first section 144 and the second section 146 on the second side 142. Although depicted as multiple independent sections, it is envisioned that at least one side (e.g., either the first side 141 or the second side 142) may be made as one component with the horizontal gap 147 being formed by bending a portion of the cross-sectional area of the side inward (e.g., toward the furnace heat exchanger 160).

Figure 5:
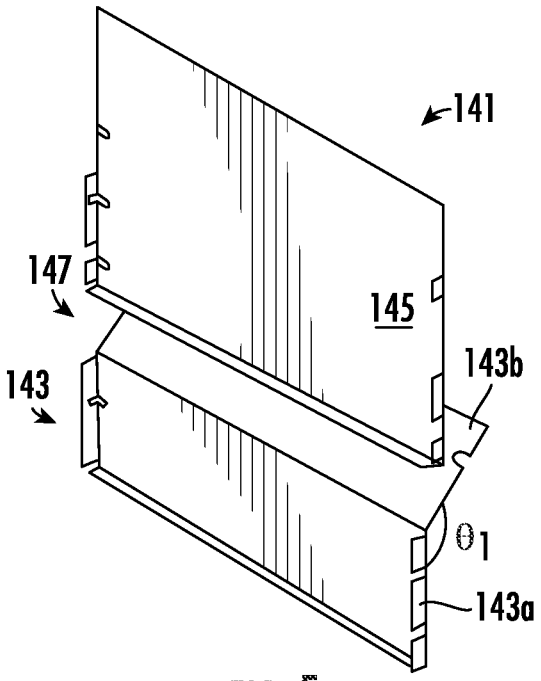
FIG. 5 is a perspective view of the first side of the baffle assembly in accordance with one aspect of the disclosure.

As shown in FIGS. 2, 4, and 5, when formed of two independent sections, the first side 141 may be viewed to include a first section 143 and a second section 145. The horizontal gap 147 may be viewed as the void (e.g., which may, in certain instances, be approximately two (2) inches wide) created between the first section 143 and the second section 145. The first section 143 of the first side 141 may include a first leg 143*a* and a second leg 143*b*, which may define a first angle Θ1 therebetween. As shown in FIG. 5, the first leg 143*a* of the first side 141 may be substantially vertically aligned (e.g., with the HVAC system 100 and/or the furnace 110), and the second leg 143*b* of the first side 141 may be bent inward (e.g. toward the furnace heat exchanger 160). This bending of the second leg 143*b* of the first side 141 may help direct air toward the furnace heat exchanger 160. For example, when the furnace heat exchanger 160 includes multiple offset bends (as is shown in FIGS. 3 and 4) the second leg 143*b* of the first side 141 may direct air toward the second bend 162 of the furnace heat exchanger 160. It should be appreciated that although the baffle assembly 140 described herein may be particularly useful for furnaces 110 with furnace heat exchangers 160 with an offset configuration, the baffle assembly 140 may also be useful for furnaces 110 with furnace heat exchangers 160 with an inline configuration (not shown).

As shown in FIGS. 3 and 4, in certain instances the furnace heat exchanger 160 includes a first bend 161, a second bend 162, and a third bend 163, where the second bend 162 is offset from the first bend 161 and the third bend 163. It should be appreciated that these bends may be interconnected (e.g., where the furnace heat exchanger 160 is a bent round tube type heat exchanger, as shown in FIG. 3). As mentioned above, in certain instances, the second leg 143*b* of the first side 141 may be bent inward toward the second bend 162 of the furnace heat exchanger 160. To be bent inward toward the second bend 162, the first angle $\Theta_1$ may be between 130° and 160° (e.g., +/−) 10°. It should be appreciated that the exact angle may be dependent on the configuration and/or size of the furnace heat exchanger 160. For example, the first angle $\Theta_1$ may be larger when the bends of the furnace heat exchanger 160 are farther apart (e.g., with a larger offset). As mentioned above, the second bend 162 may be offset from the first bend 161 and the third bend 163 of the furnace heat exchanger 160. As shown in FIG. 4, in certain instances, the first bend 161 and the third bend 163 are in substantial alignment with one another (e.g., meaning that they are on approximately the same vertical plane). To compliment this alignment, the first leg 143*a* of the first section 143 of the first side 141 and the second section 145 of the first side 141 may be approximately planar (e.g., on approximately the same vertical plane, equally spaced furnace heat exchanger 160). It is envisioned that this complimentary configuration of the first side 141 of the baffle assembly 140 with the furnace heat exchanger 160 may help to guide the airflow in a more uniform pattern over the furnace heat exchanger 160, which may generate a more uniform transfer of heat from the furnace heat exchanger 160 and the airflow.

Figure 6:
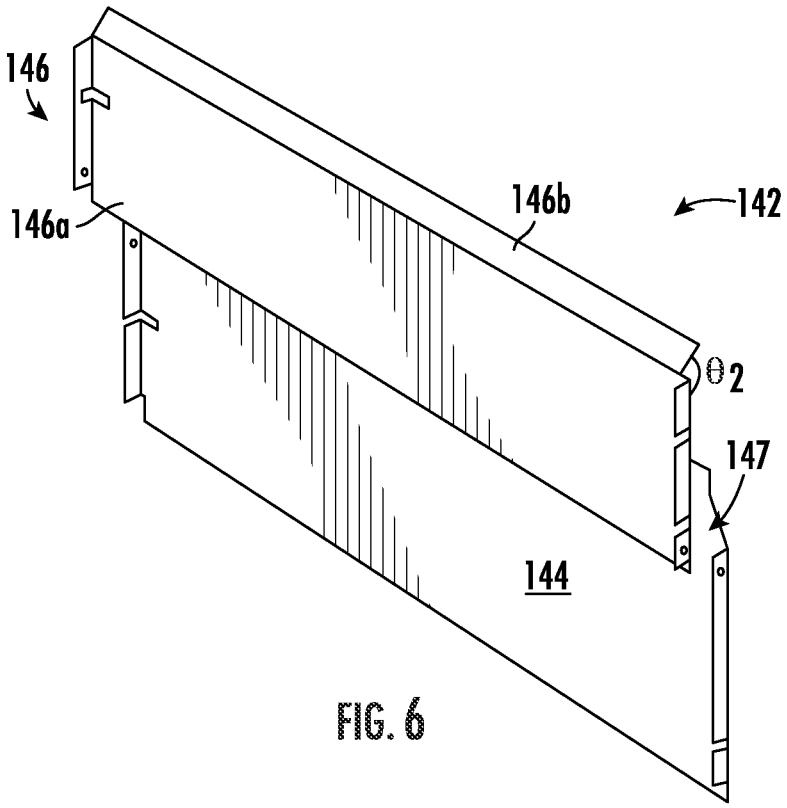
FIG. 6 is a perspective view of the second side of the baffle assembly in accordance with one aspect of the disclosure.

In certain instances, the second side 142 also has a complimentary configuration with the furnace heat exchanger 160. For example, the second side 142 of the baffle assembly 140 may be configured to compliment the offset between the second bend 162 and the third bend 163 of the furnace heat exchanger 160. As with the first side 141, the second side 142 may, in certain instances, be formed of two independent sections (e.g., a first section 144 and a second section 146). The horizontal gap 147 may be viewed as the void (e.g., which may, in certain instances, be approximately two (2) inches wide) created between the first section 144 and the second section 146. As shown in FIG. 6, the second section 146 of the second side 142 may include a first leg 146*a* and a second leg 146*b*, which may define a second angle $\Theta_2$ therebetween. As shown in FIG. 6, the first section 144 of the second side 142 and the first leg 146*a* of the second section 146 of the second side 142 may be may be substantially vertically aligned (e.g., with the HVAC system 100 and/or the furnace 110), and the second leg 146*b* of the second section 146 of the second side 142 may be bent inward (e.g. toward the furnace heat exchanger 160). This bending of the second leg 146*b* of the second side 142 may help direct air toward the furnace heat exchanger 160. For example, when the furnace heat exchanger 160 includes multiple offset bends (as is shown in FIGS. 3 and 4) the second leg 146*b* of the second section 146 of the second side 142 may direct air toward the third bend 163 of the furnace heat exchanger 160. To be bent inward toward the third bend 163, the second angle $\Theta_2$ may be between 130° and 160° (e.g., +/−) 10°. It should be appreciated that the exact angle may be dependent on the configuration and/or size of the furnace heat exchanger 160. For example, the second angle $\Theta_2$ may be larger when the bends of the furnace heat exchanger 160 are farther apart (e.g., with a larger offset). As mentioned above and shown in FIG. 4, the first bend 161 and the third bend 163 may be in substantial alignment with one another (e.g., meaning that they are on approximately the same vertical plane).

To compliment this alignment, the first section 144 of the second side 142 and the first leg 146*a* of the second section 146 of the second side 142 may be approximately parallel (e.g., on separately vertical planes). For example, the first section 144 of the second side 142 and the first leg 146*a* of the second section 146 of the second side 142 may both be positioned vertically (e.g., when the HVAC system 100 is position in a vertical fashion), but the first section 144 of the second side 142 may be positioned more inward (e.g., closer to the first bend 161 of the furnace heat exchanger 160) than the first leg 146*a* of the second section 146. In certain instances, the spacing between the first section 144 of the second side 142 and the first bend 161 of the furnace heat exchanger 160 is approximately the same as the spacing between the first leg 146*a* of the second section 146 of the second side 142 and the second bend 162 of the furnace heat exchanger 160. It is envisioned that this complimentary configuration of the second side 142 of the baffle assembly 140 with the furnace heat exchanger 160 may help to guide the airflow in a more uniform pattern over the furnace heat exchanger 160, which may generate a more uniform transfer of heat from the furnace heat exchanger 160 and the airflow.

To simplify the manufacturing process, it is envisioned that the first side 141 and the second side 142 of the baffle assembly 140 may be made of similar components. For example, the first section 143 of the first side 141 and the second section 146 of the second side 142 may be approximately identical components. Being an approximately identical component may mean that the features (e.g., the exact angle of) of each component are designed to be the same, however, due to machining tolerances, small differences may be found. For example, the first angle $\Theta_1$ and the second angle $\Theta_2$ may be designed to be identical, however, inconsistent machining may lead to small differences (e.g., +/−) 2°. Likewise, the second section 145 of the first side 141 and the first section 144 of the second side 142 may be approximately identical components (e.g., with approximately identical lengths/widths and attachment features). It should be appreciated that, the independently configured components (e.g., where no two of the sections are designed to be identical) is also envisioned.

The use of the terms "a" and "and" and "the" and similar referents, in the context of describing the invention, are to be construed to cover both the singular and the plural, unless otherwise indicated herein or cleared contradicted by context. The use of any and all example, or exemplary language (e.g., "such as", "e.g.", "for example", etc.) provided herein is intended merely to better illuminate the invention and does not pose a limitation on the scope of the invention unless otherwise claimed. No language in the specification should be construed as indicating any non-claimed elements as essential to the practice of the invention.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heating, ventilation, and/or air conditioning (HVAC) system comprising:

an evaporator coil;

a furnace in airflow communication with the evaporator coil, the furnace comprising:

a furnace heat exchanger;

a baffle assembly disposed adjacent to the furnace heat exchanger, the baffle assembly comprising at least one horizontal gap; and a fan in airflow communication with the furnace heat exchanger and the evaporator coil, wherein the baffle assembly comprises a first side and a second side, and further wherein the first side or both the first side and the second side comprise a first section and a second section, the at least one horizontal gap disposed between the first section and the second section, wherein the first section of the first side comprises a first leg and a second leg, a first angle defined between the first leg and the second leg having a value between 130° and 160°, wherein the second section of the first side consists essentially of a first leg, wherein the first leg of the second section of the first side comprises an end which is free, wherein the first leg of the first section of the first side and the first leg of the second section of the first side are approximately planar, and wherein the second section of the second side comprises a first leg, and the first section of the second side and the first leg of the second section of the second side are approximately parallel.

2. The HVAC system of claim 1, wherein the second section of the second side further comprises a second leg, a second angle defined between the first leg and the second leg.

3. The HVAC system of claim 2, wherein the second angle is between 130° and 160°.

4. The HVAC system of claim 1, wherein the furnace heat exchanger comprises a first bend, a second bend, and a third bend, the second bend offset from the first bend and the third bend.

5. A furnace comprising:

a furnace heat exchanger;

a baffle assembly disposed adjacent to the furnace heat exchanger, the baffle assembly comprising at least one horizontal gap; and a fan in airflow communication with the furnace heat exchanger, wherein the baffle assembly comprises a first side and a second side, and further wherein the first side or both the first side and the second side comprise a first section and a second section, the at least one horizontal gap disposed between the first section and the second section, wherein the first section of the first side comprises a first leg and a second leg, a first angle defined between the first leg and the second leg having a value between 130° and 160°, wherein the second section of the first side consists essentially of a first leg, wherein the first leg of the second section of the first side comprises an end which is free, wherein the first leg of the first section of the first side and the first leg of the second section of the first side are approximately planar, and wherein the second section of the second side comprises a first leg, and the first section of the second side and the first leg of the second section of the second side are approximately parallel.

6. The furnace of claim 5, wherein the second section of the second side further comprises a second leg, a second angle defined between the first leg and the second leg.

7. The furnace of claim 6, wherein the second angle is between 130° and 160°.

8. The furnace of claim 5, wherein the furnace heat exchanger comprises a first bend, a second bend, and a third bend, the second bend offset from the first bend and the third bend.

9. The HVAC system of claim 1, wherein an end of the first leg of the second section of the first side is configured to be disposed directly adjacent to the at least one horizontal gap of the first side.

10. The HVAC system of claim 1, wherein a plurality of projections protrude orthogonally from the first leg of the second section of the first side.

11. The HVAC system of claim 1, wherein the at least one horizontal gap of the first side forms an opening that is aligned vertically with the approximately planar first section and the second section of the first side.

12. The HVAC system of claim 1, wherein the first leg of the second section of the first side is independent.

13. The furnace of claim 5, wherein an end of the first leg of the second section of the first side is configured to be disposed directly adjacent to the at least one horizontal gap of the first side.

14. The furnace of claim 5, wherein a plurality of projections protrude orthogonally from the first leg of the second section of the first side.

15. The furnace of claim 5, wherein the at least one horizontal gap of the first side forms an opening that is aligned vertically with the approximately planar first section and the second section of the first side.

16. The furnace of claim 5, wherein the first leg of the second section of the first side is independent.

* * * * *